United States Patent [19]

Johansson et al.

[11] Patent Number: 4,571,260

[45] Date of Patent: Feb. 18, 1986

[54] METHOD FOR RECOVERING THE METAL VALUES FROM MATERIALS CONTAINING TIN AND/OR ZINC

[75] Inventors: Leif Johansson; Stig A. Petersson; Bengt O. Rudling, all of Skelleftehamn, Sweden

[73] Assignee: Boliden Aktiebolag, Stockholm, Sweden

[21] Appl. No.: 696,095

[22] Filed: Jan. 29, 1985

[30] Foreign Application Priority Data

Feb. 7, 1984 [SE] Sweden ..... 8400625
Sep. 4, 1984 [SE] Sweden ..... 8404418

[51] Int. Cl.[4] ..... C22B 13/00; C22B 19/04; C22B 25/00

[52] U.S. Cl. ..... 75/21; 75/77; 75/85; 75/88; 423/96; 423/618

[58] Field of Search ..... 75/63, 77, 85, 88, 21

[56] References Cited

U.S. PATENT DOCUMENTS 2,139,065 12/1938 Betterton et al. ..... 75/14
2,926,081 2/1960 Schwartz ..... 75/77
3,123,465 3/1964 Sunday et al. ..... 75/77
4,008,075 2/1977 Petersson ..... 75/77
4,017,308 4/1977 Peterson et al. ..... 75/77
4,214,897 7/1980 Verhulst ..... 75/24

*Primary Examiner*—Melvyn J. Andrews
*Attorney, Agent, or Firm*—Burns, Doane, Swecker & Mathis

[57] ABSTRACT

The invention relates to a method for recovering the metal values from materials containing at least one of zinc and tin, by smelting the starting materials under oxidizing conditions and reducing the resultant molten bath. The starting materials are first smelted in a furnace while adding flux, to form a slag which is sluggish at selected reduction temperatures and has a low lead contents. The reduction process is carried out while charging solid carbonaceous reduction agent and optionally also sulphur- and/or chlorine-donor material to the slag. The reduction agent and optionally supplied donor material is brought into suspension with the slag, and this suspension is sustained at least during the latter phase of the reduction period, at which the lead content of the slag has fallen to beneath about 1-2%, during which phase the reduction of zinc and tin takes place. Zinc is recovered from the furnace in the form of zinc vapor, while tin optionally is removed as volatile tin sulphide, chloride or oxide, and lead and any other metal values present in the starting materials are recovered as a molten lead phase.

18 Claims, 1 Drawing Figure

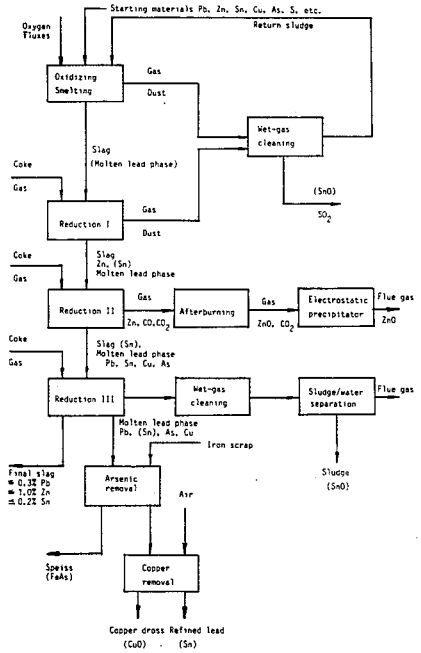

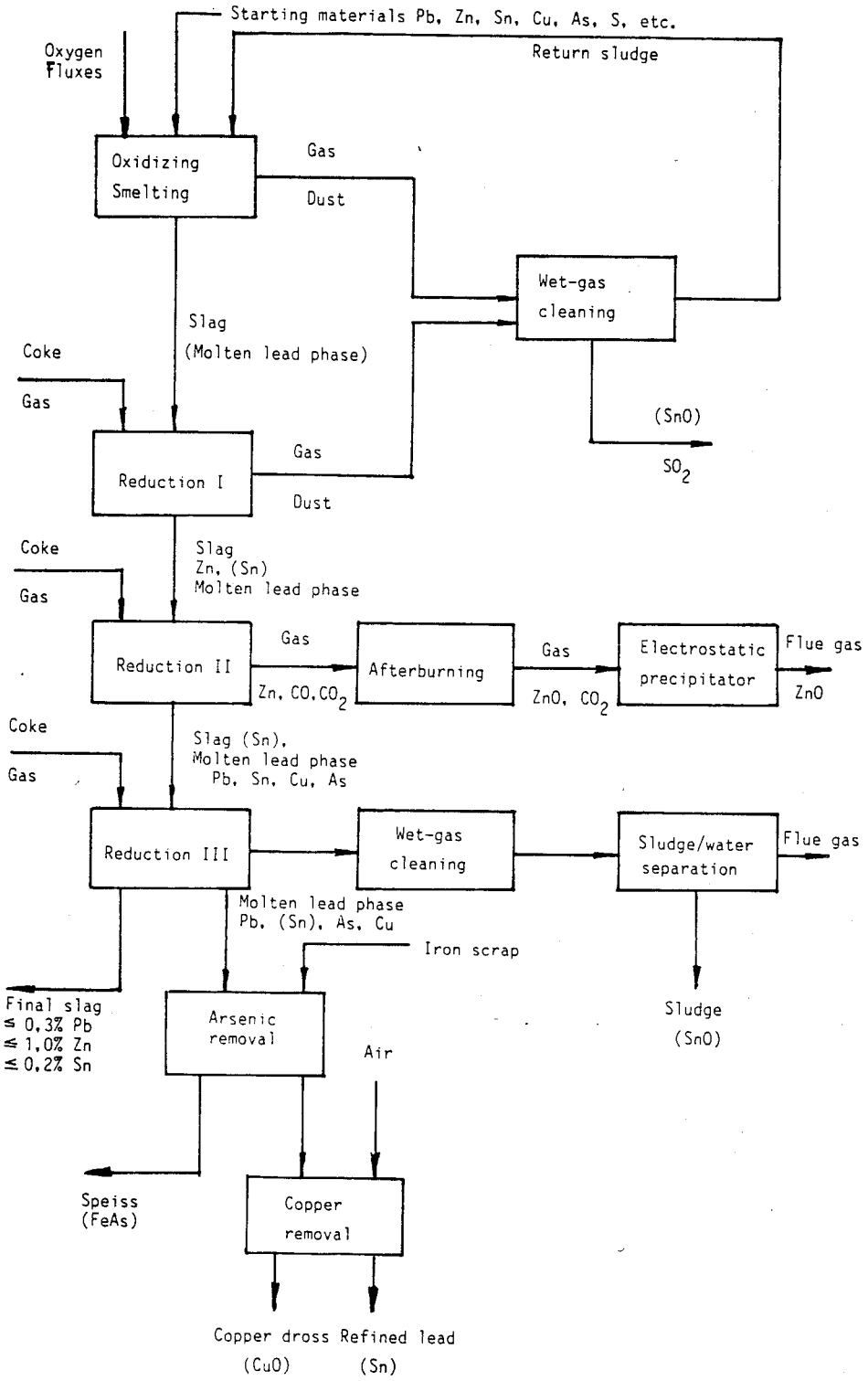
Starting materials Pb, Zn, Sn, Cu, As, S, etc.
Oxygen
Fluxes
Return sludge
Oxidizing Smelting
Gas
Dust
Wet-gas cleaning
Slag
(Molten lead phase)
Coke
Gas
(SnO)
$SO_2$
Reduction I
Gas
Dust
Coke
Gas
Slag
Zn, (Sn)
Molten lead phase
Reduction II
Gas
Zn, CO, $CO_2$
Afterburning
Gas
ZnO, $CO_2$
Electrostatic precipitator
Flue gas
ZnO
Coke
Gas
Slag (Sn),
Molten lead phase
Pb, Sn, Cu, As
Reduction III
Wet-gas cleaning
Sludge/water separation
Flue gas
Molten lead phase
Pb, (Sn), As, Cu
Iron scrap
Final slag
≤ 0,3% Pb
≤ 1,0% Zn
≤ 0,2% Sn
Arsenic removal
Sludge
(SnO)
Air
Speiss
(FeAs)
Copper removal
Copper dross
(CuO)
Refined lead
(Sn)

METHOD FOR RECOVERING THE METAL VALUES FROM MATERIALS CONTAINING TIN AND/OR ZINC

The present invention relates to a method for recovering the metal values of materials containing tin and/or zinc, by smelting the materials under oxidizing conditions and reducing the resultant melt. The invention relates to the working-up of all kinds of starting materials from which metals can be recovered in the aforesaid manner. The materials comprise first sulphidic, oxidic, sulphatic and carbonate-containing lead starting materials, together with mixtures thereof. The lead starting materials may comprise mineral concentrates, intermediate products and/or waste products. The materials also comprise other materials, which are possible to work-up in direct lead-smelting processes, which materials contain at least one of tin and zinc, for example slimes, slags and dusts, and are derived from metallurgical operations of different art.

A number of the lead-smelting processes proposed in recent years comprise, in principle, an oxidizing smelting stage and subsequent reduction of the resultant molten oxidic bath. Thus, those processes which belong to the so-called direct lead-smelting processes and which result in the formation of a molten lead bath of low sulphur content and a slag of high lead content can all be said to belong to the said group of smelting processes. The Outokumpu process (c.f. for example No. DE-C-1179004), the Cominco process (U.S. Pat. No. 3,847,595), the St. Joseph Lead process (J. Metals, 20 (12), 26–30 (1969), the Worcra process (U.S. Pat. No. 3,326,671), the Kivcet process (U.S. Pat. No. 3,555,164), and the Q-S-process (U.S. Pat. No. 3,941,587), all belong to this group.

Other lead-smelting processes which include a smelt reduction are described in Boliden's earlier patent specification U.S. Pat. No. 4,017,308 and U.S. Pat. No. 4,008,075, which relate to processes for producing metallic lead from oxidic and/or sulphatic or sulphatic or sulphidic materials with the use of a top-blown rotary converter as the smelting and reduction unit. Similar processes are described in Boliden's earlier publications EP-A- 0007890 and EP-A-0006832 which relate to processes in which metallic lead is produced from lead-containing intermediate products, and especially those which have a high copper and/or arsenic content.

A common feature of these earlier Boliden processes is that lead is produced in two stages. In the first of these stages lead starting materials and fluxes are smelted with the aid of an oxygen-fuel flame which is passed over the surface of the material in the furnace, to form a molten lead phase poor in sulphur and a slag rich in lead oxide, this lead oxide content of the slag reaching from 20–50%, normally 25–50%. In the second stage of the process, coke or some other suitable reductant is added to the molten bath and the contents thereof reduced, while heating the bath and rotating the converter.

In a later Boliden patent application, SE-A-8302486-9 (which corresponds to EP-A-0124497), there is described a single stage process in which a reducing agent is charged to the converter together with the lead starting materials. This process is to be considered as one in which the oxidizing smelting of the starting materials and the reduction of the resultant melt are effected simultaneously, and this method is thus also included in the definition of lead-smelting processes encompassed by the invention.

Hitherto it has not been possible to recover in one and the same furnace the zinc content of such starting materials in addition to the lead contained therein and optionally also other metal values thereof, such as tin. The normal procedure is to transfer the slag obtained when recovering lead to a separate furnace, for further reduction and fuming-off of the zinc present. Any tin present is also fumed-off. Such a method, referred to as slag-fuming, is described for example in Min. Mag. (Aug. 1965), Vol. 113, No. 2, pages 114–122.

When smelting and reducing lead starting materials with the aid of the processes described in the introduction, the reduction process is highly selective and if it is interrupted when the lead content of the slag is approximately 1 to 2%, only a small amount of zinc and any tin present will be fumed-off, i.e. distilled. One contributory factor in this respect may be that there are no concentration gradients in the molten bath, and neither does gas flow therethrough. This has caused problems in such processes as those in which, although difficult, it is nevertheless possible to work-up zinc-containing lead starting materials, since it is endeavoured, for process reasons, to recover at least the major part of the zinc values in one and the same stage. This means that in order to ensure that no zinc at all is fumed-off in the smelt reduction stage, it is necessary to interrupt the reduction process at lead contents above 2–3%, which causes problems when the slag is subsequently treated in a separate slag treating stage, for example by slag-fuming. In this second, slag treating stage, the residual lead content of the slag together with all zinc and any tin contained therein is fumed-off by reducing the slag at high temperatures, the lead, zinc and tin values being recovered in the form of a so-called mixed or raw oxide subsequent to oxidizing the values in the gas phase. This mixed oxide requires an additional separation stage in order to eliminate at least the major part of its lead content, before the zinc and tin values can be worked-up to useful zinc and tin products.

It has now surprisingly been found possible, however, to selectively recover in one and the same furnace any lead, zinc and tin values from materials with the aid of direct lead-smelting processes of the kind mentioned in the introduction, when the smelting process is carried out in accordance with the method according to the invention, this method being characterized by the procedural steps set forth in the following claims.

BRIEF DESCRIPTION OF THE DRAWING

The drawing is a flow sheet diagram illustrating various aspects of the present invention.

In accordance with the invention, the starting materials are smelted to form a molten bath containing a slag, in which lead, zinc, tin and possibly other less noble elements are present in oxidic form. Requisite fluxes are added in quantities adapted to impart a sluggish consistency to the slag at selected reduction temperatures, at least when the lead content of the slag has fallen to values beneath 1–2%. The molten bath is reduced with a solid carbonaceous reduction agent, for example coal or coke, which is introduced into the slag so as to form a suspension therein. In this way, the reduction agent is "incorporated" in the sluggish (viscous) slag. The reduction agent is held suspended in the slag by vigorously agitating or stirring the slag, at least during the latter part of the reduction period where the reduction of zinc and tin takes place. In accordance with the invention, the zinc reduction takes place rapidly when the lead content of the slag has fallen to 1–2%, due to the reduction of lead and the formation of a molten lead bath. As a result of the effect afforded by the finely dispersed reduction agent in the slag, the zinc oxide in the slag is reduced to metallic zinc, which is fumed-off as zinc vapour under the prevailing reducing conditions and temperature. The recovery procedures relating to any tin values present will be described more in detail hereinafter.

Tin may be removed either prior to the zinc reduction or subsequent to the same or may be effected without any zinc reduction at all. In case of tin removal prior to zinc reduction, coke and pyrite, or some other similar solid carbonaceous reduction agent and sulphur- and/or chlorine-donor material are charged to the furnace in a finely divided state and mixed with the slag, and held suspended therein by vigorously agitating or stirring the same. This agitation of the slag is an essential feature as before disclosed, when reducing tin.

The combined effect of solid carbonaceous reduction agent and sulphur- and/or chlorine-donor in suspension in the slag promotes reduction of the tin content and the formation of volatile tin(II)sulphide, SnS and/or tin chlorides, such as $SnCl_2$ and $SnCl_4$. The slag is held in suspension at selected treatment temperatures until tin has been eliminated to the extent desired.

Alternatively tin is recovered as volatile tin(II)oxide by supplying only reduction agent. Tin(II)oxide is volatilized in a separate stage subsequent to the zinc reduction. The zinc and tin reduction period may also overlap each other.

It is of course also possible and sometimes desirable to maintain at least the main part of the tin content in the molten lead phase, if such is formed, and to recover the tin content as a lead/tin alloy from the converter.

One possible explanation as to why zinc can be fumed-off according to the invention, is that carbon monoxide is formed in the slag as a result of the weakly oxidizing effect of the slag on the solid reduction agent, according to the reaction $$C+O_{slag} \rightleftharpoons CO$$

The carbon monoxide formed reacts, in turn with the zinc oxide in the slag, according to the reaction $$ZnO_{slag}+CO \rightleftharpoons Zn+CO_2$$

As a result of the sluggishness of the slag, the carbon dioxide formed in accordance with this reaction obtains a considerably extended residence time, which favours its tendency to be reduced by the solid reduction agent present in suspension in the slag, in accordance with Boudouard-reaction $$CO_2+C \rightleftharpoons 2CO$$

The carbon monoxide thus also generated in the slag is active in the further reduction of zinc oxide.

The reduction of zinc is made more effective in this manner, and when there is selected a slag composition which is viscous even at high temperature, it is possible to expel zinc from the slag at a practically stoichiometric consumption of the reduction agent (calculated on the amount of carbon).

The above discussion of the possible zinc reduction mechanism is applicable also for the tin removal, provided it is effected by forming volatile tin sulphide or chloride. The removal of tin as tin(II)oxide from the slag is, however, a mere direct volatilization process in contact with the reducing agent.

It is difficult to propose a precise slag composition for carrying out the method, since slags, in particular silicate slags, can exhibit elevated viscosities at greatly varying compositions. It can be said generally, however, that there is selected a slag composition which will retain an elevated viscosity even at temperatures in the range of 1050°–1300° C., and optionally also thereabove. When the slag is an iron calcium silicate slag, a good effect is obtained with slag compositions having the following main analysis: 20–30% $SiO_2$, 25–35% CaO, <25% FeO and 5–10% $MgO+Al_2O_3$. Having knowledge of reduction temperature and possible fluxing components in the slag, it is possible for any metallurgist to determine a suitable slag composition from case to case. One suitable composition has been found to be a ca 25% $SiO_2$, ca 30% CaO, ca 20% FeO and 6–8% $MgO+Al_2O_3$.

Since lead oxide normally improves the fluidity of the slag, it is not necessary, or even desirable for the slag to be particularly viscous during the lead reduction phase. The reduction of zinc and tin does not take place until the lead content of the slag has fallen to beneath about 2%, and consequently it is the composition of the slag after the major part of the lead has been reduced which decides the result of the zinc and tin removal phases.

The slag is suitably vigorously agitated, in order to hold the reduction agent and any sulphur- and/or chlorine-donor material supplied in suspension with the slag. Agitation can be effected in many ways, for example by mechanical, pneumatic or electrical means, although it is particularly suitable to agitate the slag by rotating the furnace. Consequently, in order to enable the method to be carried out in one and the same furnace, the starting materials are preferably smelted in a rotary converter of the Kaldo type, for example. A futher advantage obtained with rotary converters of this kind as a smelting and reduction unit is that they are particularly suitable for handling viscous slags. It is not necessary to risk a breakdown in furnace operation caused by local blockages, for example as result of solidified slag agglomerates or of a tough and doughy slag fastening in or entering the tuyeres and nozzles to block the same.

When fuming-off zinc and tin, the reduction temperature should lie within the range of 1150°–1250° C., although it may be necessary to employ lower temperatures, due to the composition of the slag. In this latter case, the kinetics of the reduction process will, of course, be impaired. Higher temperatures, of up to 1300° C. and thereabove, can be used, provided that the viscosity of the slag can be held at a sufficiently high level.

The reduction of lead, zinc and tin is, however, further accelerated when adding a solid carbonate-containing material to the slag, in addition to the reduction agent. The carbonate material is also brought in suspension in the slag, in order to utilize its positive influence on the reduction process.

The process gas leaving the furnace is accompanied with the resultant tin(II)sulphide, in those cases a sulphur-donor material has been supplied. The tin content of the gas can be recovered in some suitable manner. First, any tin sulphide present in the gas is oxidized to tin dioxide, $SnO_2$, which precipitates in the form of a solid fine-grain dust. Similarly, any tin chlorides present are also oxidized as indicated herein.

Any arsenic and zinc present in the process gas will also precipitate in the form of a solid fine-grain dust as a result of said oxidation.

The oxide dust is separated from the process gas suitably by bringing the gas into contact with water circulating in a venturi wash connected in circuit with a thickener. The circulating water is maintained at a pH beneath 6, preferably 2–3, whereby any arsenic and zinc present in the water will be dissolved therein while the tin settles to produce an oxidic slime, which is separated from the water in the thickener. This separated tin slime is filtered-off to form an oxide product containing about 50% Sn and can be suitably used for producing metallic tin in accordance with any known reduction method. For example, the slime can be smelted and reduced to form a crude tin, or can be smelted together with lead-containing material and recovered as a lead/tin alloy. Both of these tin products can be readily refined by conventional methods, to produce a pure tin metal.

The invention will now be described in more detail with reference to some preferred embodiments thereof in the form of a flow sheet diagram and a working example.

Lead starting materials containing metal values such as Cu, Zn, Sn and impurities, such as As and S are supplied to a Kaldo converter together with fluxes and there smelted in an oxidizing atmosphere by supplying oxygen to the converter to form a slag containing at least substantially the whole zinc and tin content of the smelting material. Depending on the composition of the smelting materials, a molten lead phase may also be formed at least to some extent. The process gas is lead to a wet-gas cleaning stage and any dust is then separated and recirculated as a sludge to the smelting stage, while any sulphur dioxide content in the gas is absorbed in a sulphur dioxide plant.

Reduction agents, such as coke, are supplied to the converter in a first reduction stage, designated Reduction I, in such an amount as to reduce any lead in the slag phase. The converter is heated during the reduction phases by gas heating. Reduced lead will form a molten lead phase or be taken up in such a lead phase, if already present in the converter. The process gas is lead to the same gas cleaning stage as above disclosed.

During this first reduction stage also tin may be recovered at least partially by supplying a sulphur-donor material and/or a chlorine-donor material together with the reduction agent. In such cases the process gas is oxidized prior to the gas purification stage so as to provide oxidation of tin(II)sulphide and/or tin chlorides to tin(IV) oxide, which is recovered as an oxide slime as described hereinbefore.

In reduction stage II reduction agent is supplied so as to reduce the zinc present in the slag. The outgoing reducing process gas is combusted and volatilized metallic zinc is transformed to zinc oxide, which is separated from the gas in an electric gas precipitator or a wet-gas purification plant. Reduction II may alternatively be effected to provide reduction of tin present in the slag, so that tin is transferred to the molten lead phase.

In reduction stage III any tin content in the slag, which content is present as tin(II)oxide, is removed by supplying solid reduction agent to the slag. In the presence of the reduction agent, volatilization of tin(II)oxide is promoted. Volatilized tin(II)oxide may accompany the outgoing process gas and may thereafter be oxidized to tin(IV)oxide, which is solid at actual temperatures and, thus, will be separated from the gas in a wet-gas purification plant as a tin-containing oxidic sludge or slime. Alternatively, the tin content may be recovered as metallic tin absorbed in the molten lead phase by controlling the temperature and reduction agent supply.

After reduction stage III, a metal-poor final slag is provided, which final slag is dumped.

The molten lead phase obtained may contain impurities or value elements, such as arsenic and copper, and, where actual, the main tin content. Any arsenic in the lead phase may be removed in the form of an arsenic-iron speiss after supply of iron scrap. Any copper present in the lead phase may be removed as a copper dross by oxidizing the lead phase. A refined lead, which may in actual cases contain also substantially the main tin content of the smelting materials, is obtained as an end product.

EXAMPLE

A mixture comprising 24 tons of a lead concentrate containing, inter alia, 59.3% Pb, 7.5% Zn, 1.0% Sn, 0.9% S, 1.8% Fe, 3.7% $SiO_2+Al_2O_3$ and 3.8% C (present as carbonate) together with 6 tons of a further lead concentrate containing 58.1% Pb, 8.3% Zn, 1.0% Sn, 3.5% S, 1.2% Fe, 2% $SiO_2+Al_2O_3$ and 4.26% C (present as carbonate) were charged to a Kaldo converter in batches, each comprising 6 tons, over a period of 2 hours. In addition 1.2 tons of limestone and 0.6 tons of iron oxide were charged to each batch as a flux. Further, 0.8 tons of silica was charged to the first batch, while 0.3 ton of coke was charged to the remaining batches.

The charge was heated and smelted with the aid of an oil-oxygen gas burner, wherewith 3075 liters of oil and 7690 $Nm^3$ of oxygen were consumed during the heating and smelting period. The smelting period had a duration of 240 minutes, while heating of the charge took 80 minutes. After about 160 minutes of the smelting period, when the lead content of the slag had fallen, through reduction, to beneath 2%, the slag began to become viscous. The temperature was raised slightly to about 1100° C. and maintained at this level for a further 18 minutes, whereupon mainly zinc was fumed-off. The zinc content then fell from about 15% to about 1%. Also the tin content decreased essentially. Upon completion of the zinc-reduction period, 8 tons of slag containing 1.5% Pb, 1.0% Zn, 0.2% Sn, 14.6% Fe, 27.5% $SiO_2$, 2.9% MgO, 4.1% $Al_2O_3$ and 27.9% CaO were removed from the furnace. Approximatey 20 tons of molten lead having a purity grade of 99.6% Pb were removed from the furnace. Approximately 2 tons of zinc and 0.1 tons of tin were recovered from the exiting furnace gas in a gas cleaning system.

We claim:

1. A method of recovering metal values from materials containing lead and at least one of zinc and tin comprising:

(a) smelting the materials in a furnace in the presence of a flux and under oxidizing conditions to form a molten bath containing a slag which contains lead and at least one of zinc and tin wherein the flux is selected to impart a viscous consistency to the slag at a selected reduction temperature and at low lead contents in the slag;

(b) adding a solid carbonaceous reduction agent to the furnace;

(c) suspending the reduction agent in the slag thereby decreasing the lead content in the slag by reduction;

(d) sustaining the suspension after the lead content of the slag has decreased to below about 2% whereby at least one of zinc and tin is reduced to form a vapor which is removed from the furnace; and (e) removing molten lead from the furnace.

2. The method of claim 1 wherein the slag has a composition which at the selected reduction temperature and lead content of less than 2% provides a degree of fluidity corresponding to that obtained with an iron calcium silicate slag containing 20–30% $SiO_2$, 25–35% CaO, less than 25% FeO and 5–10% $MgO+Al_2O_3$.

3. The method of claim 2 wherein the slag contains ca 25% $SiO_2$, ca 30% CaO, ca 20% FeO and 6–8% $MgO+Al_2O_3$.

4. The method of claim 1 wherein the suspension is sustained by agitating the molten bath.

5. The method of claim 2 wherein the suspension is sustained by agitating the molten bath.

6. The method of claim 3 wherein the suspension is sustained by agitating the molten bath.

7. The method of claim 1 wherein reduction is conducted at temperatures within the range 1050°–1300° C.

8. The method of claim 2 wherein reduction is conducted at temperatures within the range 1050°–1300° C.

9. The method of claim 3 wherein reduction is conducted at temperatures within the range 1050°–1300° C.

10. The method of claim 4 wherein reduction is conducted at temperatures within the range 1050°–1300° C.

11. The method of claim 1 wherein a solid carbonate-containing material is added to the slag with the reduction agent.

12. The method of claim 2 wherein a solid carbonate-containing material is added to the slag with the reduction agent.

13. The method of claim 3 wherein a solid carbonate-containing material is added to the slag with the reduction agent.

14. The method of claim 4 wherein a solid carbonate-containing material is added to the slag with the reduction agent.

15. The method of claim 7 wherein a solid carbonate-containing material is added to the slag with the reduction agent.

16. The method of claim 1 wherein tin is present in the materials and at least one of sulphur-donor material and chlorine-donor material is added to the slag so as to form at least one of volatile tin sulphide and volatile tin chloride which is converted to tin dioxide which is removed from the furnace.

17. The method of claim 16 wherein the donor material is added with the reduction agent.

18. The method of claim 1 wherein tin is present in the materials and metallic tin is absorbed by and recovered with the molten lead.

* * * * *